US006179681B1

(12) United States Patent
Matos

(10) Patent No.: US 6,179,681 B1
(45) Date of Patent: Jan. 30, 2001

(54) UNIVERSAL CONNECTOR TOY

(76) Inventor: Jose R. Matos, 8108 Fleetwood Dr., Plano, TX (US) 72025

( * ) Notice: Under 35 U.S.C. 154(b), the term of this patent shall be extended for 0 days.

(21) Appl. No.: 09/287,697

(22) Filed: Apr. 6, 1999

Related U.S. Application Data

(63) Continuation-in-part of application No. 29/083,662, filed on Feb. 13, 1998.

(51) Int. Cl.[7] ..... A63H 33/08

(52) U.S. Cl. ..... 446/116; 446/119; 446/101; 446/109

(58) Field of Search ..... 446/116, 119, 446/109, 101

(56) References Cited

U.S. PATENT DOCUMENTS

| | | | | |
|---|---|---|---|---|
| 518,067 | * | 4/1894 | Kerr | 446/109 |
| 1,193,975 | * | 8/1916 | Beardsley | 446/109 |
| 1,376,087 | * | 4/1921 | Fliendner | 446/108 |
| 1,531,099 | * | 3/1925 | Hosford . | |
| 2,061,510 | * | 11/1936 | Drumpelmann . | |
| 2,111,129 | * | 3/1938 | Rittenhouse . | |
| 2,414,716 | * | 1/1947 | Carson | 446/108 |
| 2,737,742 | * | 3/1956 | Leigh . | |
| 3,564,758 | * | 2/1971 | Willis | 446/108 |
| 4,454,678 | * | 6/1984 | Duvivier | 446/112 |
| 4,509,930 | * | 4/1985 | Schweigert et al. . | |
| 4,685,592 | * | 8/1987 | Gould et al. | 446/109 |
| 5,372,450 | * | 12/1994 | Blodgett | 403/407.1 |
| 5,823,531 | * | 10/1998 | Huber | 273/156 |
| 5,895,306 | * | 4/1999 | Cunningham | 446/108 |

* cited by examiner

*Primary Examiner*—Jacob K. Ackun
*Assistant Examiner*—Kevin M. Hughes
(74) *Attorney, Agent, or Firm*—Rick Matos; Innovar, L.L.C.

(57) ABSTRACT

The present invention provides a versatile construction kit which can be used to easily form models of virtually any conceivable person, place or thing including a variety of vehicles, buildings, people, animals, weapons, machinery, caricatures, objects and the like. The construction kit comprises plural connectors which are connectable by a tongue-and-slot mechanism and optionally also by way of interconnectable notches by which they can be perpendicularly and detachably interconnected. The universal connectors are so versatile they can form virtually any geometric, regular, irregular, asymmetric, or symmetric configuration. They can be used to form a model of any known or imagined object. Generally, the width of the notches and of the slots of the connectors substantially approximates the thickness of the connectors.

32 Claims, 6 Drawing Sheets

FIG. 1a
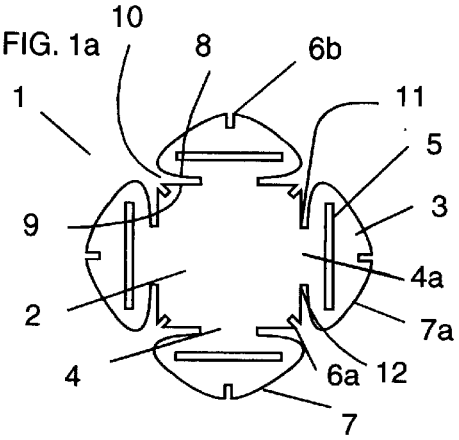
FIG. 1b
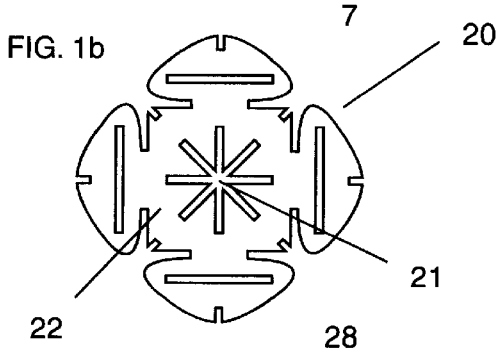
FIG. 1c
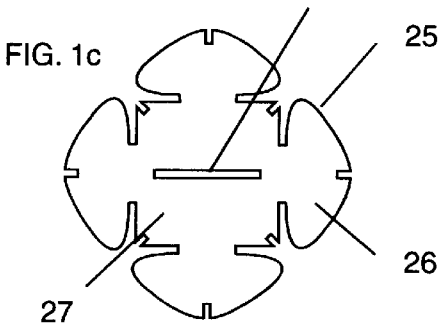
FIG. 1d
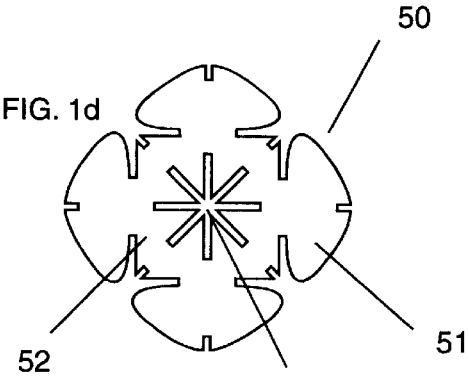
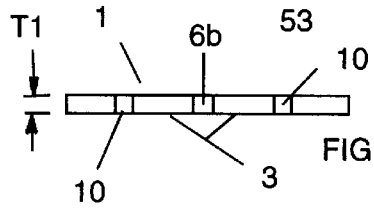
FIG. 1e
FIG. 2a
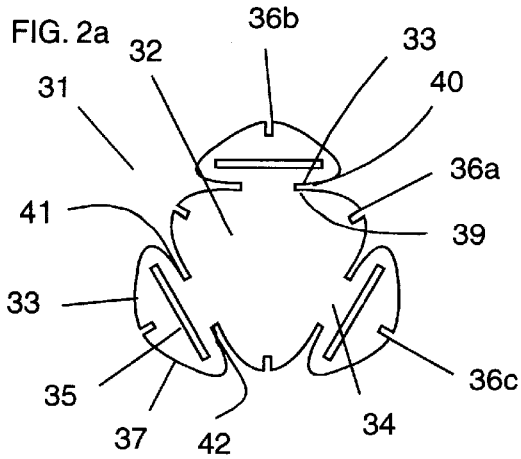
FIG. 2b
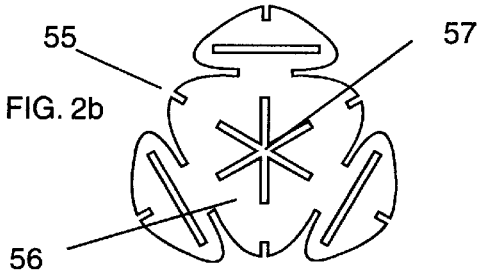
FIG. 2c
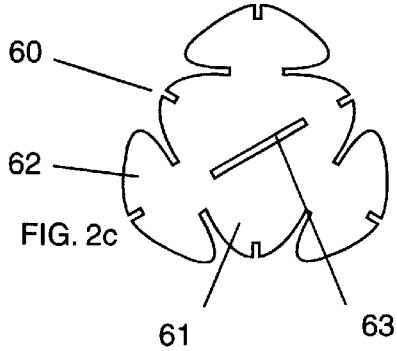
FIG. 2d
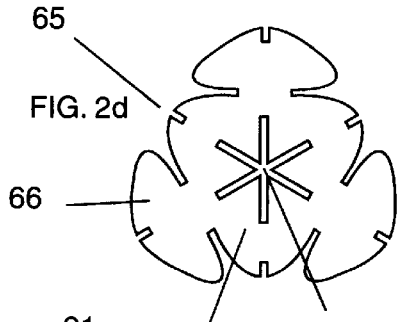
FIG. 2e
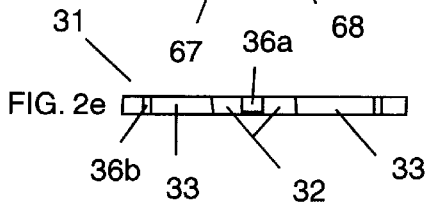

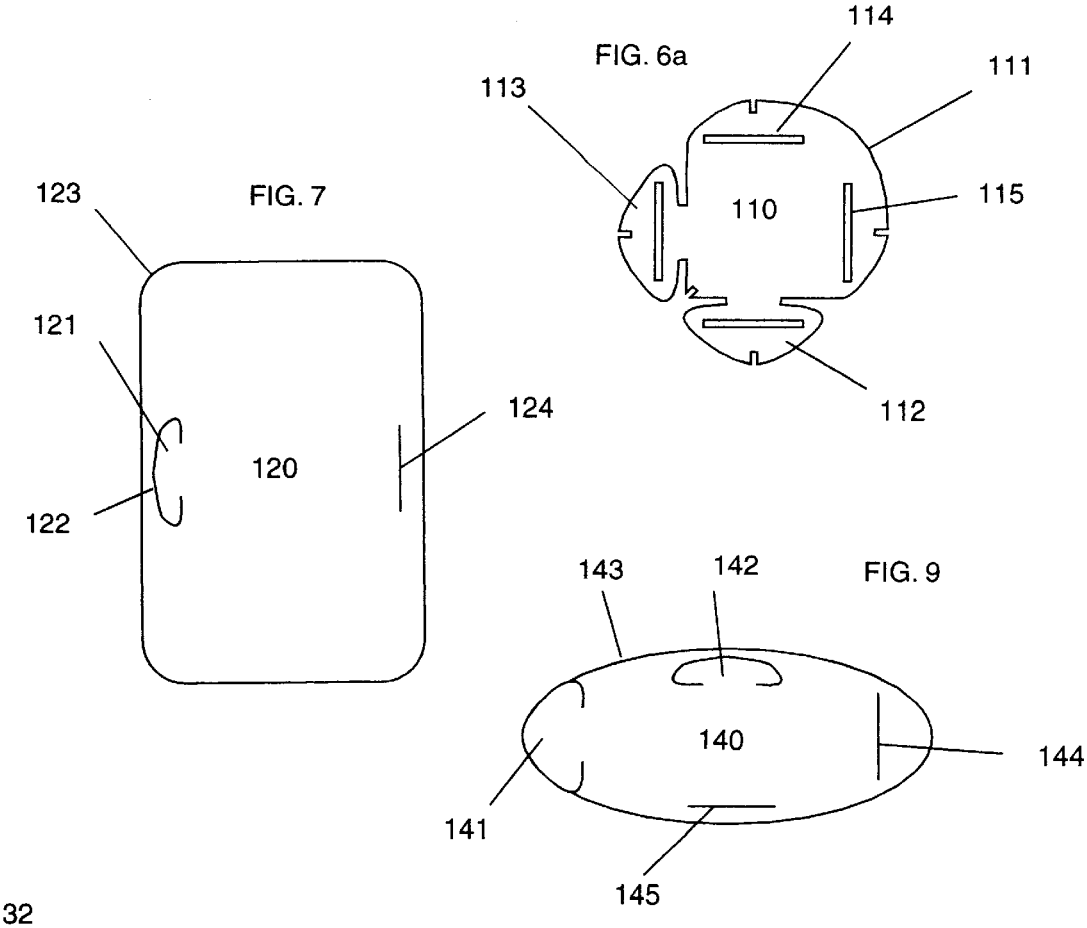
FIG. 6a
114
111
113
110
115
112
FIG. 7
123
121
124
120
122
FIG. 9
143
142
140
144
141
145
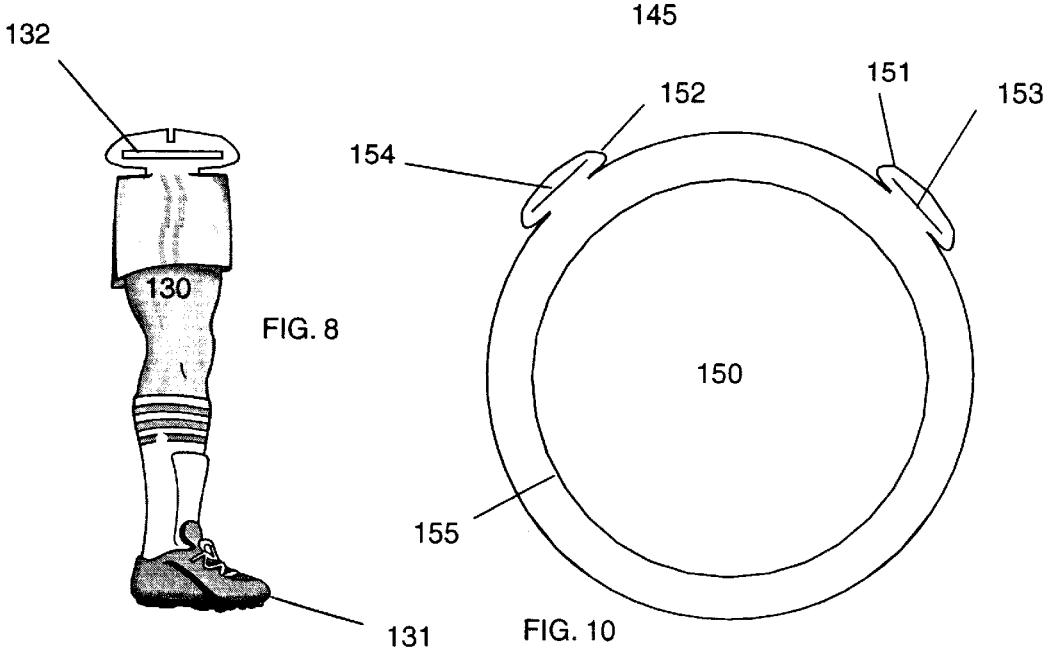
132
130
FIG. 8
131
152
151
153
154
150
155
FIG. 10

UNIVERSAL CONNECTOR TOY

CROSS-REFERENCE TO EARLIER FILED APPLICATIONS

The present application is a continuation-in-part of copending application Ser. No. 29/083,662 filed Feb. 13, 1998.

FIELD OF THE INVENTION

The present invention relates generally to a construction kit, and more specifically, to a construction kit which employs universal connectors which are connectable by a tongue-in-slot mechanism and which are available in a range of shapes and sizes for building models.

BACKGROUND OF THE INVENTION AND DESCRIPTION OF THE PRIOR ART

Construction kits and connectors are well known. Such items have employed connectors and additional members having a wide range of shapes and sizes including blocks, pyramids, rods, gears, flat panels, discs and the like. Construction kits have been used to build a respective wide range of very crude to semi-realistic models of structures such as airplanes, trains, cars, rockets, buildings, animals and more.

Known construction kits for constructing semi-realistic models generally require either one or both a large number of like-shaped connectors or a wide range of uniquely-shaped connectors generally being connectable in only one or a limited number of ways. Such construction kits quickly lose a user's interest due to either the extreme effort required to build a suitable model or the limited number of structures/models that can be made.

Known connectors employ a variety of interconnecting and interlocking means such as holes, bosses, notches, grooves, threads, and joints. Those connectors have also been made from a large variety of materials such as wood, plastic, foam and metal.

One widely available connector is the TAZO™ connector sold by Lulirama International, Inc. Such connectors are available in a variety of geometric shapes such as a circle, square, pentagon, hexagon and the like. Each TAZO™ has four to eight notches on the outer periphery of the disc. The width of the notches approximates the thickness of a TAZO™ connector. TAZO™ connectors are formed into chains or strips and other structures by detachably and perpendicularly interconnecting their notches so that adjacent TAZO™ connectors are substantially perpendicular to each other.

By interconnecting a varying number of TAZO™ connectors, some very simple geometric structures, such as a circle, sphere, rod, square, cube triangle, rectangle, block, pyramid and the like, can be formed. However, forming semi-realistic models of complicated structures such as airplanes, buildings, animals, automobiles, ships and spaceships, is almost impossible when employing solely TAZO™ connectors and if accomplished generally results in extremely large models.

There remains a need for a construction kit which can form a wide range of semi-realistic models while requiring a limited number of connectors and providing a greater number of ways in which the connectors can be connected.

SUMMARY OF THE INVENTION

The present invention overcomes some of the disadvantages of known construction kits and thus is generally directed to a versatile construction kit which is used to easily form a wide variety of semi-realistic models while requiring only a limited number of tongue-in-slot connectors. The construction kit is expanded by the addition of further connectors to permit construction of an even greater variety of semi-realistic models of virtually anything such as, by way of example, buildings, people, animals, toys, weapons, machinery, caricatures, fanciful figures, spaceships, and air, land or water borne vehicles, and other such structures.

In one aspect, the invention provides a construction kit having a variety of similarly or uniquely-shaped parts for building semi-realistic models. Thus, the present invention is a construction kit comprising a plurality of substantially planar connectors wherein each connector comprises:

- a substantially planar body having a defined thickness and being defined by a first outer periphery;
- at least one tongue member having a defined thickness and width and being defined by a second outer periphery;
- a neck member having a defined thickness and width and having a first end attached to said first outer periphery of said body and a second end attached to said second outer periphery of said at least one tongue member; and
- at least one edge defining a respective slot in at least one of said body and said tongue member, said slot having a defined length and width;

wherein:

- each of said at least one tongue member is attached to one of said neck member;
- the length of said slot is smaller than the width of said tongue member;
- the width of said slot is larger than the thickness of said tongue member and said neck member;
- a portion of said second outer periphery of said at least one tongue member which is most proximal said body is spaced from said first outer periphery of said body by a distance which at least approximates the thickness of said tongue member;
- the width of said neck member is smaller than the length of said slot; and
- said tongue member is dimensioned to be inserted through said slot.

At least one of the first and second outer peripheries can include at least one notch which width generally approximates or is smaller than the thickness of the body and the tongue member. Placement of one or more notches along the periphery of the connectors can vary to permit building a greater number of semi-realistic models.

A connector according to the invention comprises one or more or a plurality of tongue members and respective attached neck members as well as a plurality of slots. The slots can be spaced apart, connected, interconnecting or disposed as desired within the body or the tongue members of the connector.

The tongue-in-slot connectors of the invention are shaped as desired. For example, they can have a regular, irregular, geometric, asymmetric, symmetric or other shape.

The universal connectors are provided individually or in groups as individual pieces or as comprising punch-out cards.

The tongue-in-slot connectors of the invention are made of rigid, semi-rigid of flexible materials. When the connectors of the invention are properly connected and are made of the appropriate materials they will form virtually any 2- or 3-dimensional shapes and combinations thereof.

When connected by way of their notches, the tongue-in-slot connectors of the invention will interconnect substantially perpendicularly and detachably.

As the present construction kit forms semi-realistic models, the surfaces of the connectors can be adorned with any of wide range of odoriferous, optic, visual, sensual, graphic, textural, ornamental, image and/or text features.

Other features, advantages and embodiments of the invention will be apparent to those skilled in the art by the following description, accompanying examples and appended claims.

BRIEF DESCRIPTION OF THE DRAWINGS

The following drawings form part of the present specification and are included to further demonstrate certain aspects of the invention. The invention may be better understood by reference to one or more of these drawings in combination with the detailed description of the specific embodiments presented herein.

FIG. 1A is a top plan view of a first preferred embodiment of the universal connector of the invention.

FIG. 1B is a top plan view of an alternate embodiment of the universal connector according to the embodiment of FIG. 1A.

FIG. 1C is a top plan view of an alternate embodiment of the universal connector according to the embodiment of FIG. 1A.

FIG. 1D is a top plan view of an alternate embodiment of the universal connector according to the embodiment of FIG. 1A.

FIG. 1E is a front elevation of the universal connector according to the embodiments of FIGS. 1A–1D.

FIG. 2A is a top plan view of a second preferred embodiment of the universal connector of the invention.

FIG. 2B is a top plan view of an alternate embodiment of the universal connector according to the embodiment of FIG. 2A.

FIG. 2C is a top plan view of an alternate embodiment of the universal connector according to the embodiment of FIG. 2A.

FIG. 2D is a top plan view of an alternate embodiment of the universal connector according to the embodiment of FIG. 2A.

FIG. 2E is a front elevation of the universal connector according to the embodiments of FIGS. 2A–2D.

The top plan view for each of the universal connector embodiments depicted in FIGS. 1A–1D, 2A–2D and 3A–3D is the same as its respective bottom plan view.

The right side, left side and rear elevations for each of the universal connector embodiments depicted in FIGS. 1A–1D is the same as the front elevation depicted in FIG. 1E.

Figure 3A:
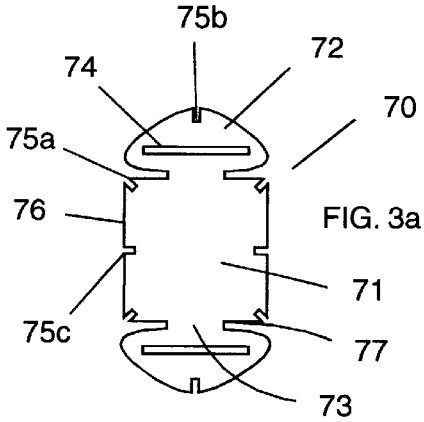
FIG. 3A is a top plan view of a third preferred embodiment of the universal connector of the invention.
Figure 3B:
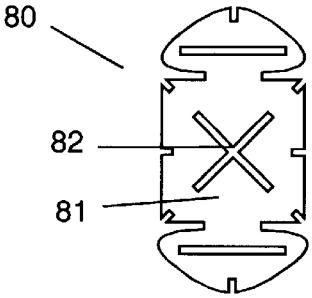
FIG. 3B is a top plan view of an alternate embodiment of the universal connector according to the embodiment of FIG. 3A.
Figure 2H:
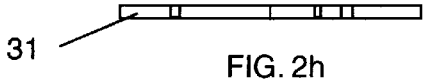
FIG. 2H is a right side elevation of the universal connector according to the embodiments of FIGS. 2A–2D.
Figure 3F:
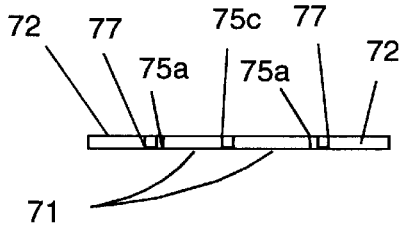
FIG. 3F is a left side elevation of the universal connector according to the embodiments of FIGS. 3A–3D.
Figure 3C:
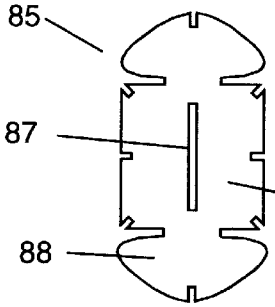
FIG. 3C is a top plan view of an alternate embodiment of the universal connector according to the embodiment of FIG. 3A.
Figure 3D:
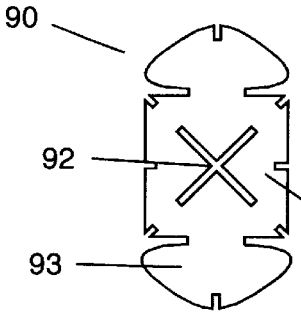
FIG. 3D is a top plan view of an alternate embodiment of the universal connector according to the embodiment of FIG. 3A.
Figure 3E:
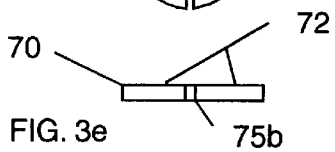
FIG. 3E is a front elevation of the universal connector according to the embodiments of FIGS. 3A–3D.

The rear elevation for each of the universal connector embodiments depicted in FIGS. 3A–3D is the same as front elevation depicted in FIG. 3E.

The right side elevation for each of the universal connector embodiments depicted in FIGS. 3A–3D is the same as the left side elevation depicted in FIG. 1F.

FIG. 6A is a top plan view of a fifth preferred embodiment of the universal connector of the invention.

Figure 6B:
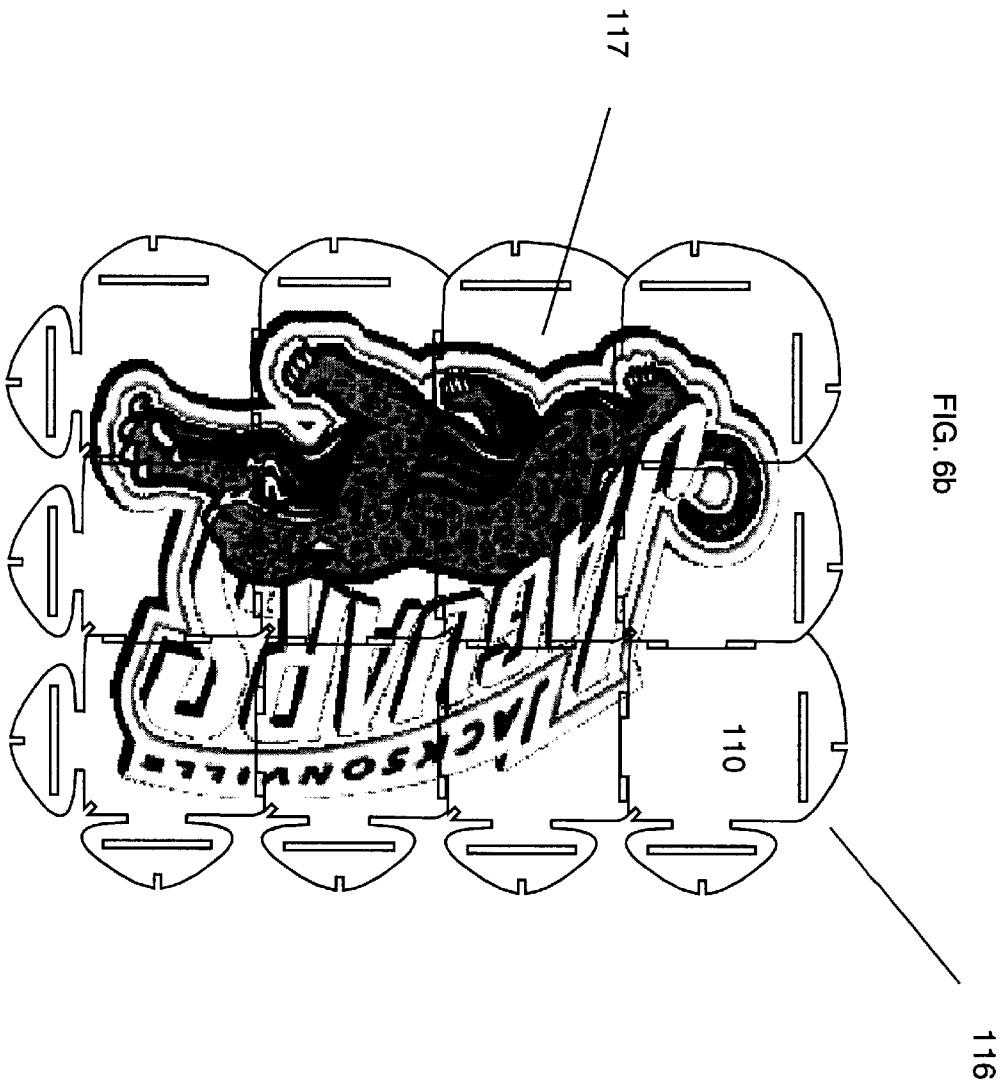

FIG. 6B is a top plan view of sheet bearing a logo using the universal connector of FIG. 6A.

FIG. 7 is a top plan view of a sixth preferred embodiment of the universal connector of the invention.

FIG. 8 is a top plan view of a seventh preferred embodiment of the universal connector of the invention.

FIG. 9 is a top plan view of an eighth preferred embodiment of the universal connector of the invention.

FIG. 10 is a top plan view of a ninth preferred embodiment of the universal connector of the invention.

Figure 11A:
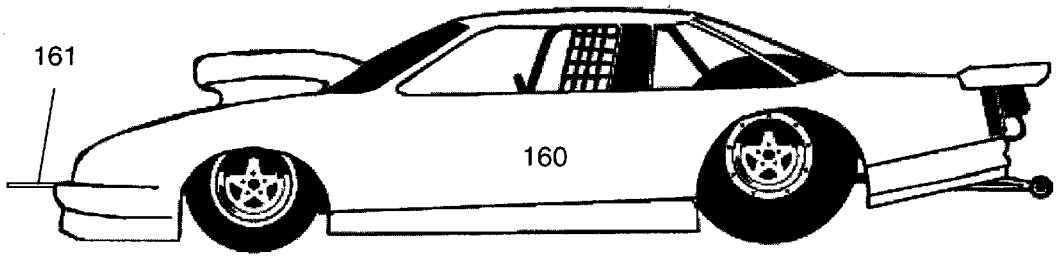

FIG. 11A is a perspective view of a tenth preferred embodiment of the universal connector of the invention.

Figure 11B:
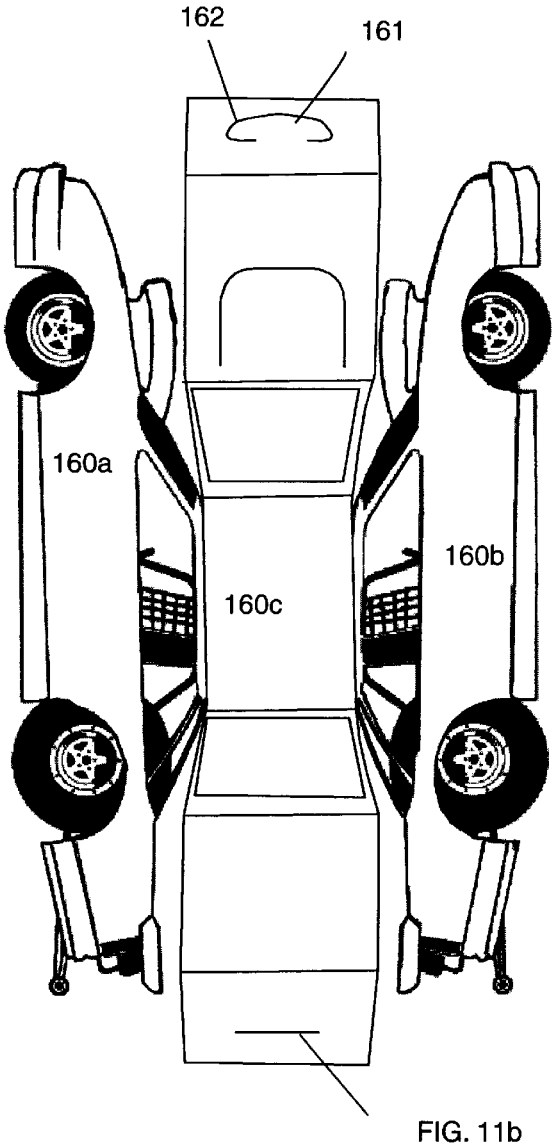

FIG. 11B is a top plan view of the universal connector of FIG. 11A after it has been unfolded.

DETAILED DESCRIPTION OF THE INVENTION

The invention is a construction kit comprising at least two connectors which can be connected by employing a tongue-in-slot mechanism and optionally an interconnecting notch-to-notch mechanism. The tongue of the connector is dimensioned to be inserted through the slot of the connector. Since the length of the slot is smaller than the width of the tongue, the connection formed by the tongue-in-slot design is substantially stronger and less susceptible to accidental disconnection than is the connection formed by the notch-to-notch design. When connected, the connectors of the invention can form fanciful to semi-realistic models of a variety of structures.

By "semi-realistic" is meant appearing to at least some degree as it would in real life or as depicted by a space-filled three-dimensional model.

FIG. 1A depicts one particular embodiment of the tongue-in-slot connector (1) employed in the present invention wherein connector (1) has four tongue members (3) each attached to the body (2) by way of respective neck members (4) which neck members each have respective first (11) and second (12) edges. Each of the tongue members (3) has an edge defining a slot (5), and each tongue member (3) is defined by an outer periphery (7). In this particular embodiment, the outer periphery (7) of each tongue member includes at least one notch (6*b*). The body (2) is defined by an outer periphery (9) which includes plural notches (6*a*) evenly distributed radially along the outer periphery (9) of the body (2). The width of notches (6*a*, 6*b*) generally approximates the thickness of connector (1), the tongue member (3), the body (2) or the neck (4). The notches are optional, and if a plurality is present, they can be radially spaced as desired along the outer peripheries (7) and (9) of the connector (1).

By "tongue member" is meant a male member which is dimensioned to be inserted ire the slot or slit of the connector. The tongue member is shaped as desired, and while its length can approximate its width, its length is preferably longer than its width. The shape of the tongue member can include any shape such as, by way of example and without limitation, a square, rectangle, circle, oval, ellipse, trapezoid, parallelogram, pentagon, hexagon, heptagon, any polygon, any geometric shape, irregular shape, regular shape, symmetric shape, asymmetric shape and combinations thereof. The tongue member can also be shaped as any known, imaginary or fanciful figure, person, place, or thing or its silhouette.

When more than one tongue member is present in a connector, the shape of the connectors can be selected independently and need not be the same. In a preferred embodiment, the tongue members on a single connector are shaped the same. In another preferred embodiment, the tongue members on all the connectors in a construction kit are shaped the same.

The length of the slot (5) is generally shorter than the width of the tongue member (3) and longer than the width of the neck member (4). The width of the slot (5) can be slightly smaller but preferably approximates or is larger than the thickness of the tongue member (3) and the neck member (4). The tongue member (3) is dimensioned to be inserted through the slot (5). A portion (8)of the outer periphery (7) of the tongue member (3) which is most proximal the body (2) is spaced from the outer periphery (9) of the body by a distance (10) which can be slightly smaller but preferably approximates or is greater than the thickness (T1 in FIG. 1E) of the tongue member (3).

Figure 2F:
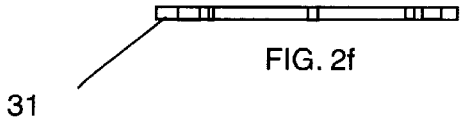
FIG. 2F is a rear elevation of the universal connector according to the embodiments of FIGS. 2A–2D.
Figure 2G:
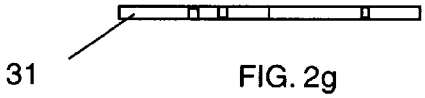
FIG. 2G is a left side elevation of the universal connector according to the embodiments of FIGS. 2A–2D.

FIGS. 2A and 3A depict other exemplary embodiments contemplated for the tongue-in-slot connector of the invention. The connector is any generally flat article and in some embodiments is foldable. By "connector" is meant a substantially planar connector having a thickness substantially narrower than the longest length of the connector. Although the body (2) of the connector (1) is depicted with a square shape, the body (2) can be circular, approximately circular, elliptical, rectangular (FIGS. 3A–3D), triangular (FIGS. 2A–2D) or other regular, irregular, geometric asymmetric or symmetric shape. For example, FIG. 8 depicts an universal connector shaped as a leg and FIGS. 11*a* and 11*b* depict an universal connector shaped as a race car. The connector (1) generally has a thickness that is at least five fold smaller, preferably seven fold smaller, more preferably 10 fold smaller than its length. By "approximately circular" is meant a multi-sided geometric shape, or polygon, having five or more sides so that the shape will roughly or closely approximate that of a circle. An approximately circular connector can be shaped as a pentagon, hexagon, heptagon, octagon or any multi-sided polygon having nine or more sides. The connector is shaped as desired for a particular application.

The connector (1) is generally intended to be substantially planar as exemplified by flat, concave, convex, corrugated and the like configurations. The connector (1) can also have any one or more of depressions, ridges, ribs, bosses, projections, indentation, dimples, odoriferous agents, light reflective materials, light absorptive materials, water absorptive materials, water repellent and the like on its surface. In some embodiments, such as that depicted in FIGS. 11*a* and 11*b*, the connector is foldable into a three dimensional structure.

The interconnecting mechanism employed by the various connectors of the invention involves a tongue-in-slot design or mechanism wherein the tongue member of a first connector is dimensioned to be inserted through the slot of a second connector. According to the materials used to make the connector, the connected connectors may form a substantially perpendicular to substantially planar or coplanar connection by way of the tongue-in-slot mechanism. If the connectors are interconnected by way of notches, the connected connectors will form a substantially perpendicular detachable interconnection. By "substantially perpendicular" is meant that the planes which define respective connectors will be substantially normal to each other when the respective connectors are interconnected. By "interconnecting" is meant employs two snugly fitting parts to form a connection. For example, notches (6*a*) and (6*b*) are approximately the same width as the thickness of the connector (1). When a first connector (1) is interconnected with a second connector (1) by way of any of the notches (6*a*) and (6*b*), they form a snug fitting perpendicular and detachable interconnection.

The tongue-in-slot design or mechanism of the connectors employed herein are intended to be interlocking. By "interlocking" is meant employs a male tongue member and a female slot, aperture, hole or slit, to form a connection which is not easily susceptible to disconnection and which involves insertion of the tongue member through the slot.

The connectors of the invention can be rigid, semi-rigid or flexible and can comprise materials such as, by way of example and without limitation, wood, plastic, rubber, cardboard, paperboard, paper, film, metal, laminates, foils, glass, leather, vinyl, combinations thereof and the like. Essentially any material that is not extremely brittle can be used in the connectors of the invention.

Figure 4A:
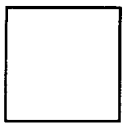
FIGS. 4A–4N are top plan views of various preferred embodiments of the slot employed in the connector of the invention.
Figure 4B:
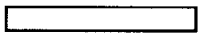
Figure 4C:
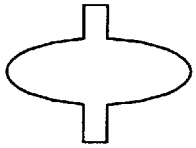
Figure 4D:
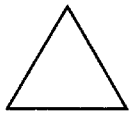
Figure 4E:
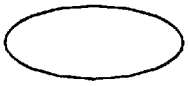
Figure 4F:
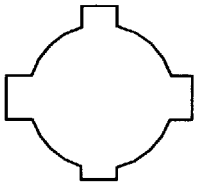
Figure 4G:
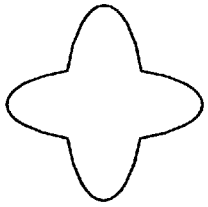
Figure 4H:
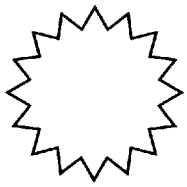
Figure 4I:
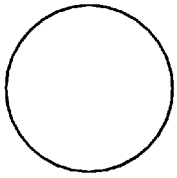
Figure 4J:
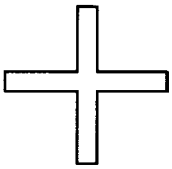
Figure 4K:
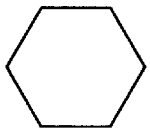
Figure 4L:
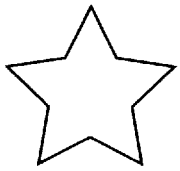
Figure 4M:
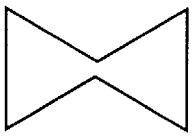
Figure 4N:
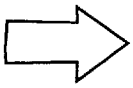

The terms "slot" or "slit" are taken to mean any aperture disposed in the connector of the invention and which is dimensioned to received a tongue member as herein described. Although the slot (5) can generally be of any desired shape, it must be so shaped as to permit complete insertion of the tongue member (3) and at least momentary retention of the tongue member (3) therein. The length of the slot (5) can be larger but preferably approximates and more preferably is smaller than the width of the tongue member (3). The length of the slot (5) can approximate but is preferably larger than the width of the slot (5). Within the above limits, the shape of the slot (5) can be selected as desired. For example, the slot can have a regular, irregular, geometric, symmetric, asymmetric shape or combinations thereof. Particular non-limiting and exemplary embodiments for the shape of the slot are depicted in FIGS. 4A–4N and can include a square (FIG. 4A), rectangle (FIG. 4B), combined rectangle and oval (FIG. 4C), triangle (FIG. 4D), oval (FIG. 4E), combined rectangles and circle (FIG. 4F), plural ovals (FIG. 4G), starburst (FIG. 4H), circle (FIG. 4I), cross (FIG. 4J), hexagon (FIG. 4K), multi-pointed star (FIG. 4L), intersecting geometric shapes such as intersecting triangles (FIG. 4M), arrow (FIG. 4N), multi-sided polygon, ellipse, trapezoid, parallelogram, pentagon, silhouette of any known, imaginary or fanciful person, place or thing and combinations thereof. It should be noted that plural slots can be disposed anywhere on a connector of the invention. They can be separate, connecting, or interconnecting.

The notch (6*a*) or (6*b*) of a first connector (1) need only be sufficiently wide to permit detachable and perpendicular interconnection with the notch of a second connector (1). It should also be noted that the notches can have different lengths. For example, the notches (6*a*) and (6*b*) of the connector (1) are generally as long as they are wide, i.e. its length approximates its width. However, the notches (6*a*) and (6*b*) can be longer than they are wide. As well, it is contemplated that the angle of incidence of the notches (6*a*) and (6*b*) relative to the outer peripheries (7) and (9), respectively, of the connector (1) can be varied.

Since the connectors of the invention preferably have a plurality of radially spaced tongue members and optionally notches on their outer peripheries, models employing them can advantageously be constructed in a variety of different forms thereby enhancing their semi-realistic appearance.

Since a construction kit according to the invention will generally comprise plural tongue-in-slot connectors, the construction kit can comprise at least one and preferably more than one type or embodiment of a connector. Thus, FIGS. 1A–1D, 2A–2D and 3A–3D depict various exemplary preferred and alternate embodiments of the connector which differ in the number and disposition of their tongue members, slots and optional notches.

In FIG. 1A, the connector (1) has a slot (5) in each of the four tongue members (3). The outer periphery (9) of the planar body (2) has plural radially spaced notches (6*a*), one notch (6*b*) on each of the vertices. The outer periphery (7) has plural radially spaced notches (6*b*), one on each of the four tongue members. The planar body (2) has no slot.

FIG. 1B depicts the connector (20) which is an alternate embodiment of the preferred connector (1) but which includes a slot (21) disposed within the body (22). The slot (21) comprises plural bisecting rectangles.

FIG. 1C depicts the connector (25) which is an alternate embodiment of the preferred connector (1) but which includes a rectangular slot (22) disposed within the body (27) and no slots disposed within the tongue members (26).

FIG. 1D depicts the connector (50) which is an alternate embodiment of the preferred connector (1) but which includes a slot (53) disposed within the body (52) and no slots disposed within the tongue members (51). The slot (53) comprises plural bisecting rectangles.

The preferred embodiment depicted in FIG. 2A for the connector (31) is different than the connector (1) in that the connector (31) has only three tongue members (33) and a planar body (32) in the shape of a triangle with rounded corners. The tongue members (33) are each attached to a first end of a respective neck member (34) which has a second end attached to the planar body (32). Each tongue member (33) has a slot (35) and a notch (36*b*), and the planar body (32) has no slot but has plural notches (36*a*).

FIG. 2B depicts the connector (55) which is an alternate embodiment of the preferred connector (31) but which includes a slot (57) disposed within the body (56). The slot (57) comprises plural bisecting rectangles.

FIG. 2C depicts the connector (60) which is an alternate embodiment of the preferred connector (31) but which includes a slot (63) disposed within the body (61) and no slots disposed within the tongue members (62).

FIG. 2D depicts the connector (65) which is an alternate embodiment of the preferred connector (31) but which includes a slot (68) disposed within the body (67) and no slots. disposed within the tongue members (66). The slot (68) comprises plural bisecting rectangles.

The preferred embodiment depicted in FIG. 3A for the connector (70) is different than the connectors (1) and (31) in that the connector (70) has only two tongue members (72) and a planar body (71) in the shape of a square. The tongue members (72) are each attached to a first end of a respective neck member (73) which has a second end attached to the planar body (71). Each tongue member (72) has a slot (74) and a notch (75*b*), and the planar body (71) has no slot but has plural notches (75*a*) and (75*c*) on its vertices and sides, respectively.

FIG. 3B depicts the connector (80) which is an alternate embodiment of the preferred connector (70) but which includes a slot (82) disposed within the body (81). The slot (82) comprises plural bisecting rectangles.

FIG. 3C depicts the connector (85) which is an alternate embodiment of the preferred connector (70) but which includes a slot (87) disposed within the body (86) and no slots disposed within the tongue members (88).

FIG. 3D depicts the connector (90) which is an alternate embodiment of the preferred connector (70) but which includes a slot (92) disposed within the body (91) and no slots disposed within the tongue members (93). The slot (92) comprises plural bisecting rectangles.

Figure 5:
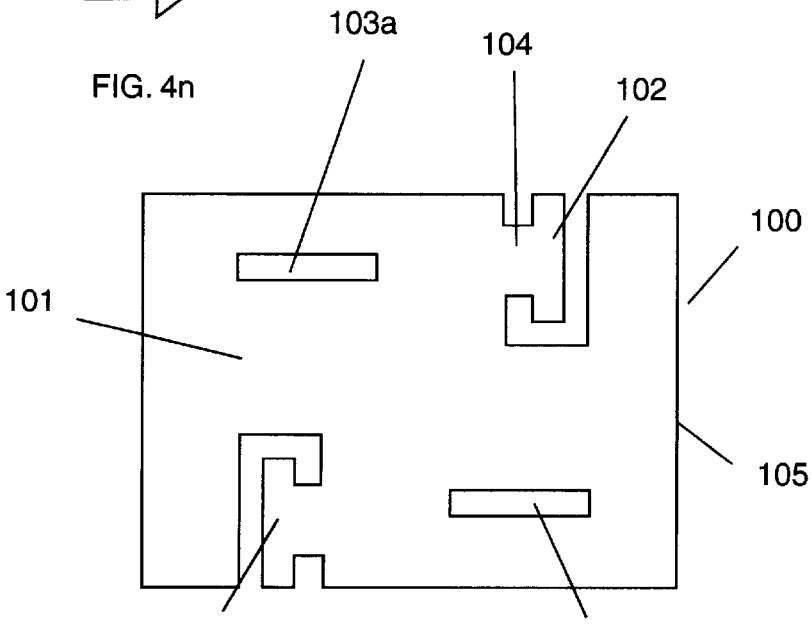
FIG. 5 is a top plan view of a fourth preferred embodiment of the universal connector of the invention.

The tongue member of the connector need not extend outwardly, i.e. radially, from the center of the connector as depicted in FIGS. 1A–1D, 2A–2D and 3A–3D. The tongue members can extend also inwardly toward the center of the planar body or at any angle between inward and outward extension. For example, FIG. 5 depicts a connector (100) having a tongue member (102) which extends in a direction substantially along a portion of the outer periphery (105) of the body (101). The tongue member (102) is attached to the body by way of the neck member (104) and is dimensioned to be inserted within either of the slots (103*a*, 103*b*). The two spaced slots (103*a*, 103*b*) are disposed within the body (101).

FIG. 6*a* depicts an alternate embodiment of the universal connector, wherein the connector (110) has a generally rounded-square shape with rounded corners and the tongue members (112, 113) are disposed along the outer periphery (111). The slots or apertures (114, 115) are disposed within the body of the connector. This embodiment is particularly suitable for preparing sheets (such as depicted in FIG. 6*b*) of connected connectors having a minimal amount of open space between the connectors. The sheet (116) bears a logo, design or assembled image (117) formed from plural image sections borne by individual connectors (116).

Although, only a sheet shaped is depicted herein, the connectors of the invention can be combined to from any known or imagined two- or three-dimensional shape.

FIG. 7 depicts the universal connector (120) which comprises a tongue member (121) disposed within the body of the connector and not along the outer periphery (123) of the connector. The tongue member (121) is formed by the aperture or slit (122). The slot (124) is adapted to receive a tongue member like (121) but from another connector (not shown). By placement of the tongue member (121) within the body of the connector, substantially the surface of the connector can bear graphic imagery or text while minimizing the amount of area that is lost by forming out the tongue member.

FIG. 8 depicts a universal connector (130) shaped as a human leg wherein the tongue member (131) is shaped as a shoe and the slot (132) is formed in the hip portion of the leg. This type of universal connector in combination with other connectors shaped as other human body parts can be used to form characters, such as athletes and movie stars. Of course, substantially any object can be formed with these universal connectors by using appropriately shaped connectors.

FIG. 9 depicts a universal connector (140) shaped as a football comprising a first tongue member (141) formed by the outer periphery (143), a second tongue member (142) formed by a slit within the body of the connector and two slots, or slits, (144, 145) formed by cuts or slits within the body of the universal connector. These types of connectors are particularly suitable for forming assembled structures resembling the individual connectors themselves. For example, plural substantially two-dimensional football-shaped connectors (140) can be connected to form a three-dimensional football-shaped structure.

FIG. 10 depicts a universal connector (150) which is a medallion or locket. For example, the central region of the connector can include a locket type structure (155) to hold pictures or other articles. The tongue members (151, 152) and slots (153, 154) are used to connect to other universal connectors (not shown) which form a strip, chain or necklace type structure, such that the medallion and necklace can be worn by a user. The central region can also include an adhesive by which objects or image bearing materials can be adhered to the connector.

FIGS. 11*a* and 11*b* depict a connector (160) that is foldable to form a three-dimensional race car. The connector (160) comprises three sections (160*a*, 160*b*, and 160*c*) which are folded along fold lines to form the race car. The tongue member (161) in the front of the car is formed by way of a slit (162). A slit or slot (163) is engaged with other tongue members (161) from other cars to form a chain or line of engaged cars. In much the same way, other connectors which are foldable are used to form a train, parade, caravan or other similar structures.

Generally, all of the connectors of the invention are interchangeable and interconnectable, and a wide variety of semi-realistic models can be made with any given kit.

The individual construction kits contemplated by the invention are generally provided with a plurality of tongue-in-slot connectors for constructing at least one semi-realistic model of anything such as, for example, a car, person, vehicle, animal, building, toy weapon, machinery, caricatures, fanciful figure, caricature, geographic location, landmark, icon, molecule, atom, and the like.

The connectors of the invention can be provided individually, in groups comprising connectors, or generally as punch-outs from a punch-out card. In a punch-out card, outlines of the connectors are cut, die cut, etched, pressed, laser cut, printed, punched, or the like onto a suitable base sheet made of the desired material. When desired, the precut connectors are punched-out (or pressed or pushed out) from the base sheet and used. The connectors can also be provided unassembled or pre-assembled.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

What is claimed is:

1. A construction kit comprising a plurality of substantially planar tongue-in-slot connectors wherein each tongue-in-slot connector comprises:

a substantially planar body having a defined first thickness and being defined by a first periphery;

at least one tongue member having a defined second thickness and second width and being defined by a second periphery;

at least one neck member having a defined third thickness and third width and having a first end attached to said body and a second end attached to said at least one tongue member; and at least one edge defining a respective slot entirely at least one of said body and said at least one tongue member, said slot having a defined length and fourth width;

wherein:

said tongue-in-slot connectors are each unitary integral pieces the length of said slot is smaller than the width of said tongue member;

the width of said neck member approximates or is smaller than the length of said slot; and said tongue member is dimensioned to be inserted through said slot.

2. The construction kit of claim 1, wherein each of at least two of said connectors has at least one notch disposed on at least one of said first and second peripheries whereby the two connectors can be interconnected.

3. The construction kit of claim 2, wherein the width of each of said at least one notch approximates or is smaller than at east one of said first thickness, said second thickness and said third thickness.

4. The construction kit of claim 1, wherein the width of said slot approximates or is larger than the thickness of said tongue member and said neck member.

5. The construction kit of claim 1, wherein the shape of said at least one tongue member is independently selected at each occurrence from the group consisting of a square, rectangle, circle, oval, ellipse, trapezoid, parallelogram, pentagon, starburst, cross, multi-pointed star, intersecting geometric shapes, hexagon, heptagon, polygon, geometric shape, irregular shape, regular shape, symmetric shape, asymmetric shape; a known, imaginary or fanciful figure, person, place or thing; silhouettes thereof; and combinations thereof.

6. The construction kit of claim 1, wherein the shape of the slot is independently selected at each occurrence from the group consisting of a square, rectangle, circle, oval, ellipse, trapezoid, parallelogram, pentagon, starburst, cross, multi-pointed star, intersecting geometric shapes, hexagon, heptagon, polygon, geometric shape, irregular shape, regular shape, symmetric shape, asymmetric shape; a known, imaginary or fanciful figure, person, place or thing; silhouettes thereof; and combinations thereof.

7. The construction kit of claim 1, wherein at least one of said connectors comprises a plurality of tongue members and respective neck members.

8. The construction kit of claim 1, wherein at least one of said connectors comprises a plurality of edges defining respective slots.

9. The construction kit of claim 1, wherein said connectors are made from materials independently selected at each occurrence from the group consisting of wood, plastic, rubber, cardboard, paperboard, paper, film, metal, laminate, foil, glass, leather, vinyl, and combinations thereof.

10. The construction kit of claim 1, wherein the shape of said connectors is independently selected at each occurrence from the group consisting of a square, rectangle, circle, oval, ellipse, trapezoid, parallelogram, pentagon, starburst, cross, multi-pointed star, intersecting geometric shapes, hexagon, heptagon, polygon, geometric shape, irregular shape, regular shape, symmetric shape, asymmetric shape; any known, imaginary or fanciful figure, person, place or thing; silhouettes thereof; and combinations thereof.

11. The construction kit as recited in claim 1, wherein a surface of said connector comprises any one or more of depressions, ridges, ribs, bosses, projections, indentations, dimples, odoriferous agents, light reflective materials, light absorptive materials, water absorptive materials, water repellent materials and combinations thereof.

12. The construction kit as recited in claim 1, wherein at least one of said connectors is foldable into a three dimensional shape.

13. The construction kit of claim 1, wherein a portion of said second periphery that is most proximal said body is spaced from said first periphery by a distance, which at least approximates the thickness of said tongue member.

14. The construction kit of claim 1, wherein the connectors form a two-dimensional or three-dimensional shape when assembled.

15. A planar construction piece comprising:

a substantially planar body having a defined first thickness and being defined by a first periphery;

at least one tongue member having a defined second thickness and second width and being defined by a second periphery;

at least one neck member having a defined third thickness and third width and having a first end attached to said planar body and a second end attached to said second tongue member; and at least one edge defining a slot entirely within at least one of said planar body and said at least one tongue member, said slot having a defined length and fourth width;

wherein:

said construction piece is a unitary integral piece said second width is longer than the length of said slot; and said third width approximates or is smaller than the length of said slot.

16. The planar construction piece of claim 15 further comprising at least one notch disposed on at least one of said first and second peripheries.

17. The planar construction piece of claim 16, wherein each of said notches has the same length.

18. The planar construction piece of claim 15, wherein said fourth width approximates or is larger than said second thickness and said third thickness.

19. The planar construction piece of claim 15, wherein said connector comprises a plurality of tongue members and respective neck members.

20. The planar construction piece of claim 15, wherein a portion of said second periphery that is most proximal said body is spaced from said first periphery by a distance, which at least approximates the thickness of said tongue member.

21. The planar construction piece of claim 15, wherein said connector comprises a plurality of edges defining respective slots in said body.

22. The planar construction piece of claim 15, wherein said connector is foldable into a three-dimensional shape.

23. The planar construction piece of claim 15, wherein the tongue member is also defined by the first periphery of the body.

24. The planar construction piece of claim 15, wherein the tongue member is defined by a slit or slot in the body.

25. The planar construction piece of claim 15, wherein the construction piece comprises at least two tongue members or at least two slots.

26. The planar construction piece of claim 15, wherein the shape of said at least one tongue member is independently selected at each occurrence from the group consisting of a square, rectangle, circle, oval, ellipse, trapezoid, parallelogram, pentagon, starburst, cross, multi-pointed star, intersecting geometric shapes, hexagon, heptagon, polygon, geometric shape, irregular shape, regular shape, symmetric shape, asymmetric shape; a known, imaginary or fanciful figure, person, place or thing; silhouettes thereof; and combinations thereof.

27. The planar construction piece of claim 15, wherein the shape of the slot is independently selected at each occurrence from the group consisting of a square, rectangle, circle, oval, ellipse, trapezoid, parallelogram, pentagon, starburst, cross, multi-pointed star, intersecting geometric shapes, hexagon, heptagon, polygon, geometric shape, irregular shape, regular shape, symmetric shape, asymmetric shape; a known, imaginary or fanciful figure, person, place or thing; silhouettes thereof; and combinations thereof.

28. The planar construction piece of claim 15, wherein said connector is made from a material selected from the group consisting of wood, plastic, rubber, cardboard, paperboard, paper, film, metal, laminate, foil, glass, leather, vinyl, and combinations thereof.

29. The planar construction piece of claim 15, wherein the shape of said connector is selected from the group consisting of a square, rectangle, circle, oval, ellipse, trapezoid, parallelogram, pentagon, starburst, cross, multi-pointed star, intersecting geometric shapes, hexagon, heptagon, polygon, geometric shape, irregular shape, regular shape, symmetric shape, asymmetric shape; any known, imaginary or fanciful figure, person, place or thing; silhouettes thereof; and combinations thereof.

30. The planar construction piece of claim 15, wherein a surface of said connector comprises any one or more of depressions, ridges, ribs, bosses, projections, indentations, dimples, odoriferous agents, light reflective materials, light absorptive materials, water absorptive materials, water repellant materials and combinations thereof.

31. The construction kit of claim 3, wherein each of the notches has the same width.

32. The construction kit of claim 31, wherein each of the notches has the same length.

* * * * *